US006105678A

United States Patent [19]

Tsai

[11] Patent Number: 6,105,678

[45] Date of Patent: Aug. 22, 2000

[54] HEAT RESPONSIVE FIRE EXTINGUISHING ASSEMBLY FOR A VENTILATING DUCT

[75] Inventor: Tien-Shou Tsai, Taichung Hsien, Taiwan

[73] Assignee: Shie Yu Machine Parts Industrial Co., Ltd., Taiwan

[21] Appl. No.: 09/193,914

[22] Filed: Nov. 17, 1998

[51] Int. Cl.[7] ..... A62C 37/00

[52] U.S. Cl. ..... 169/54; 169/58; 169/42

[58] Field of Search ..... 169/54, 58, 60, 169/5, 16, 37, 42, DIG. 3

[56] References Cited

U.S. PATENT DOCUMENTS

| | | | |
|---|---|---|---|
| 4,830,117 | 5/1989 | Capasso | 169/90 |
| 5,199,500 | 4/1993 | Norman et al. | 169/51 |
| 5,228,520 | 7/1993 | Gottschalk | 169/17 |
| 5,570,745 | 11/1996 | MacDonald, III | 169/16 |
| 5,667,017 | 9/1997 | Hoffmann et al. | 169/38 |

*Primary Examiner*—Andres Kashnikow
*Assistant Examiner*—Lisa Ann Douglas
*Attorney, Agent, or Firm*—Christensen, O'Connor, Johnson & Kindness PLLC

[57] ABSTRACT

A fire extinguishing assembly is used in a ventilating duct which has an inner wall, an outer wall, and an insert hole that extends in a radial direction from the outer wall to the inner wall. The fire extinguishing assembly includes a mounting seat having an inner seat wall to be mounted on the outer wall of the duct to cover the insert hole, and an outer seat wall with an inner peripheral seat. The inner peripheral seat defines a through hole that extends to the inner seat wall, and an annular insert portion that extends from the inner seat wall and that is in fluid communication with the through hole. The insert portion can be inserted fittingly into the insert hole to establish fluid communication between the ventilating duct and the through hole. An elongate fire extinguishing body has a connecting end portion, a free end portion formed with a nozzle head that can be brought to pass through the insert portion to extend inwardly of the inner wall via the insert hole. A heat fusible and gas impermeable cap member has a closed end portion to isolate hermetically the nozzle head from an interior of the ventilating duct, and an annular end portion that is exposed outwardly of the duct through the through hole and that forms an annular edge. A mounting flange is integrally formed with and extends outwardly from the annular edge.

5 Claims, 4 Drawing Sheets

HEAT RESPONSIVE FIRE EXTINGUISHING ASSEMBLY FOR A VENTILATING DUCT

BACKGROUND OF THE INVENTION

1. Field of the Invention

The invention relates to a fire extinguishing assembly, more particularly to a heat responsive fire extinguishing assembly for a ventilating duct.

2. Description of the Related Art

A conventional fire extinguishing assembly is known in the art and is generally mounted on a ceiling of a room in a building. The conventional fire extinguishing assembly includes an elongate fire extinguishing body having a connecting end portion in fluid communication with a fire extinguishing solution reservoir, a free end portion disposed to be in fluid communication with the connecting end portion, a valve member disposed between the connecting and free end portions to control the fluid communication therebetween, a nozzle head disposed in the free end portion for discharging the fire extinguishing solution when the valve member is in an on state, and a heat detecting sensor adapted to actuate the valve member to the on state when the heat detected thereby reaches a predetermined value.

It is noted that the nozzle head is generally exposed to the atmosphere and is therefore unsuitable for use in a ventilating duct, such as one for drawing a hazardous gas out of a worksite and the like. This is due to the fact that reaction or chemical action of the hazardous gas relative to the atmosphere may cause blockage in the nozzle head.

SUMMARY OF THE INVENTION

Therefore, the object of this invention is to provide a fire extinguishing assembly for use in a ventilating duct and which has a protective cap member to cover the nozzle head thereof so as to avoid the occurrence of blockage in the nozzle head.

Accordingly, a heat responsive fire extinguishing assembly of this invention is to be used in a ventilating duct which has an inner wall, an outer wall opposite to the inner wall in a radial direction, and an insert hole that extends in a radial direction from the outer wall to the inner wall. The fire extinguishing assembly includes a mounting seat, an elongate fire extinguishing body, a protective cap member, a clamping ring, and a tightening member. The mounting seat has an inner seat wall adapted to be mounted on the outer wall of the ventilating duct so as to cover the insert hole, and an outer seat wall. The outer seat wall has an inner peripheral seat to define a first through hole therein that extends to the inner seat wall. The mounting seat further has an annular insert portion that extends from the inner seat wall and in fluid communication with the first through hole. The annular insert portion is of such a dimension so as to be adapted to be inserted fittingly into the insert hole to establish fluid communication between an interior of the ventilating duct and the first through hole. The fire extinguishing body has a connecting end portion adapted to be in fluid communication with a fire extinguishing solution reservoir, a free end portion disposed to be in fluid communication with the connecting end portion and to be brought to pass through the annular insert portion so as to be adapted to extend inwardly of the inner wall via the insert hole, and a valve member disposed between the free end portion and the connecting end portion to control the fluid communication therebetween during in on and off states. A nozzle head is disposed in the free end portion for discharging the fire extinguishing solution when the valve member is in the on state. A heat detecting sensor is disposed in the free end portion and is adapted to actuate the valve member to the on state when the heat detected thereby reaches a predetermined value. The protective cap member is made of a heat fusible and gas impermeable material, and has a closed end portion, an annular end portion that extends in a longitudinal direction from a periphery confining the closed end portion so as to form an annular edge distal to the closed end portion. The protective cap member is disposed to isolate hermetically the free end portion from the interior of the ventilating duct, and further has a mounting flange integrally formed with and extending outwardly and transversely from the annular edge. The mounting flange is of a dimension to abut against the inner peripheral seat when the protective cap member is brought to cover the free end portion and is led to pass through the first through hole from the outer seat wall so as to be adapted to protrude inwardly of the inner wall of the ventilating duct. The clamping ring is disposed to be sleeved movably on the fire extinguishing body so as to be brought to abut against the mounting flange. The tightening member forces the clamping ring to abut against the mounting flange, thereby tightly sandwiching the mounting flange between the clamping ring and the inner peripheral seat.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
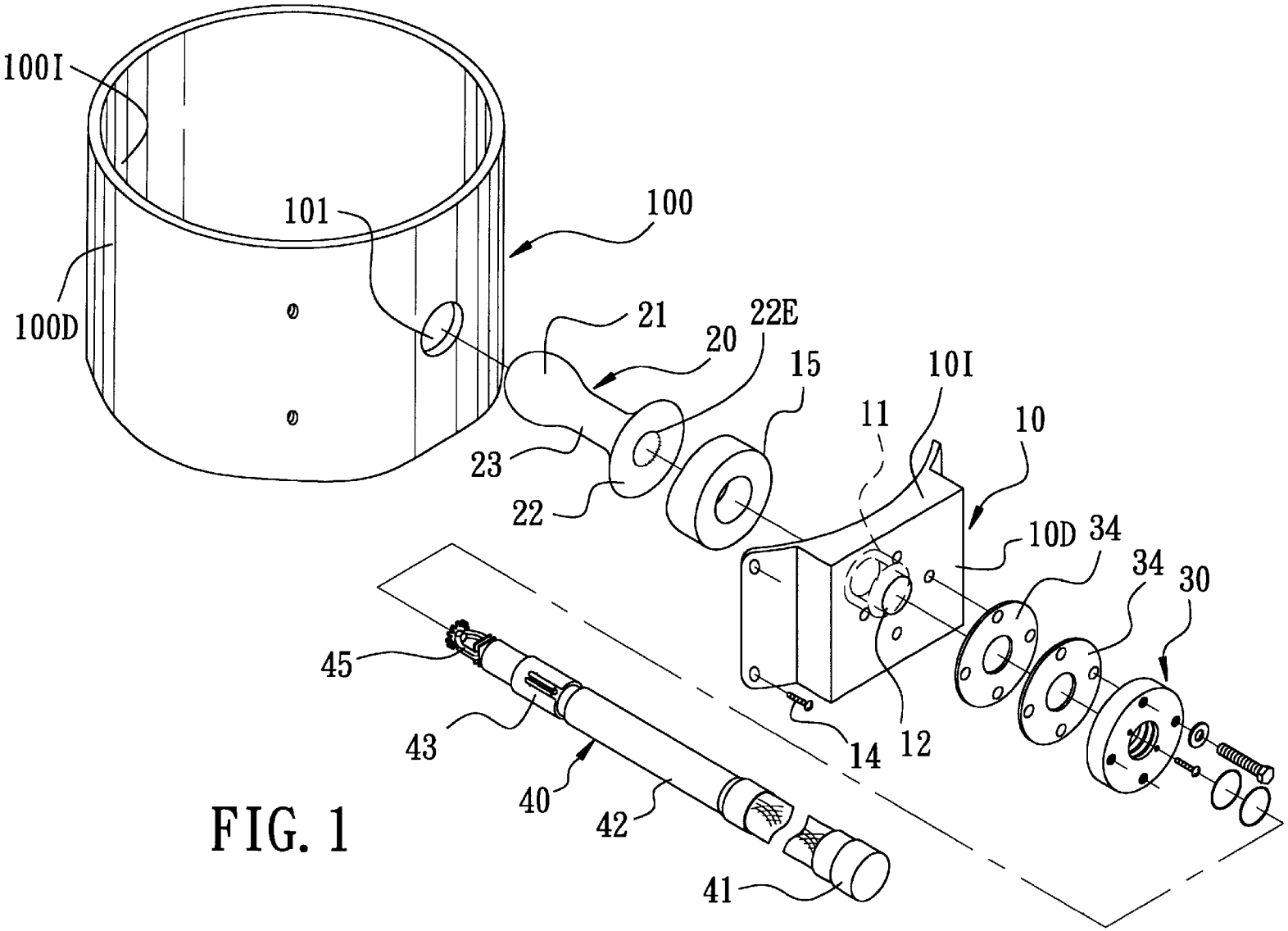
FIG. 1 is an exploded view of the preferred embodiment of a fire extinguishing assembly of this invention.
Figure 2:
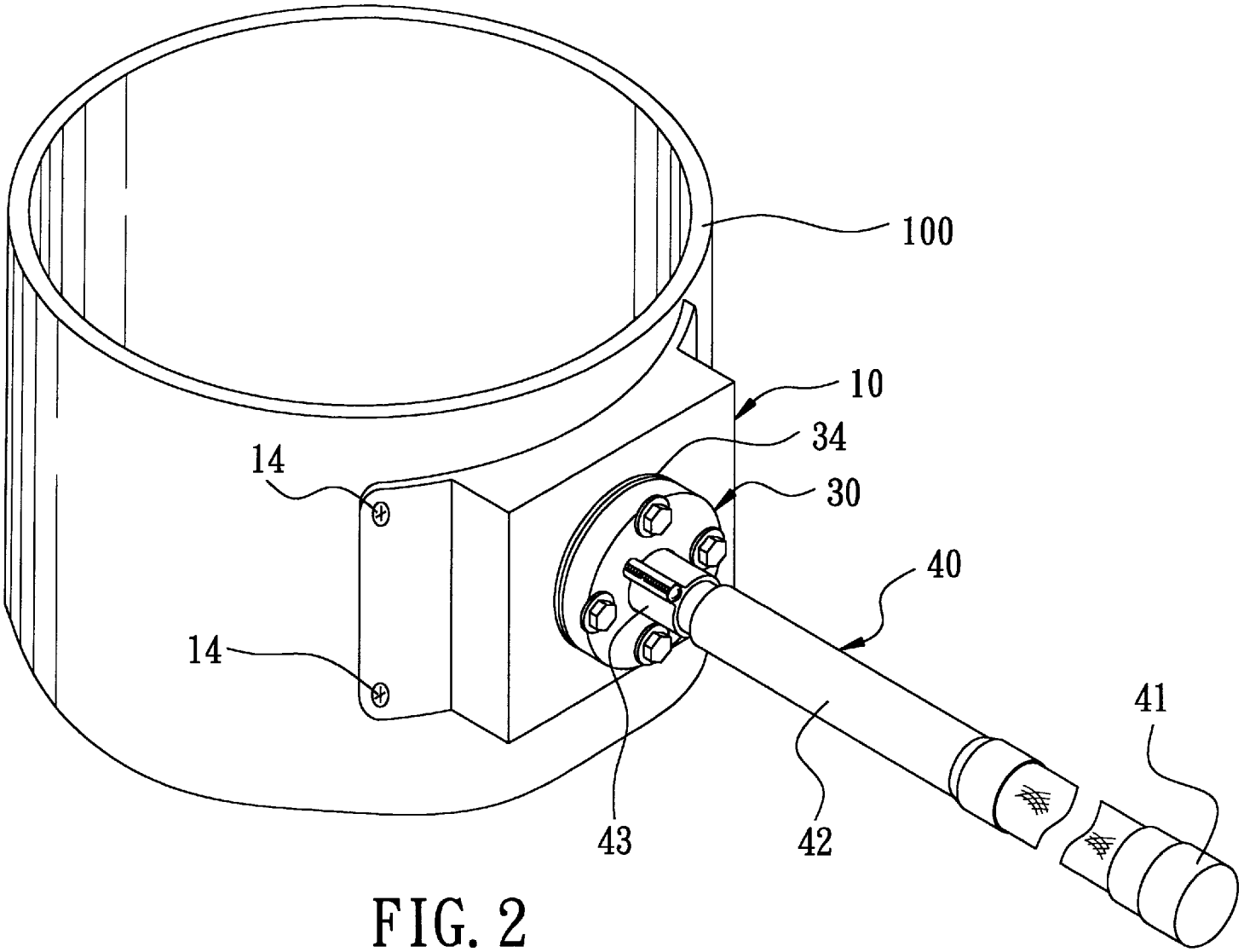
FIG. 2 is a perspective view of the preferred embodiment when mounted on a ventilating duct.
Figure 3:
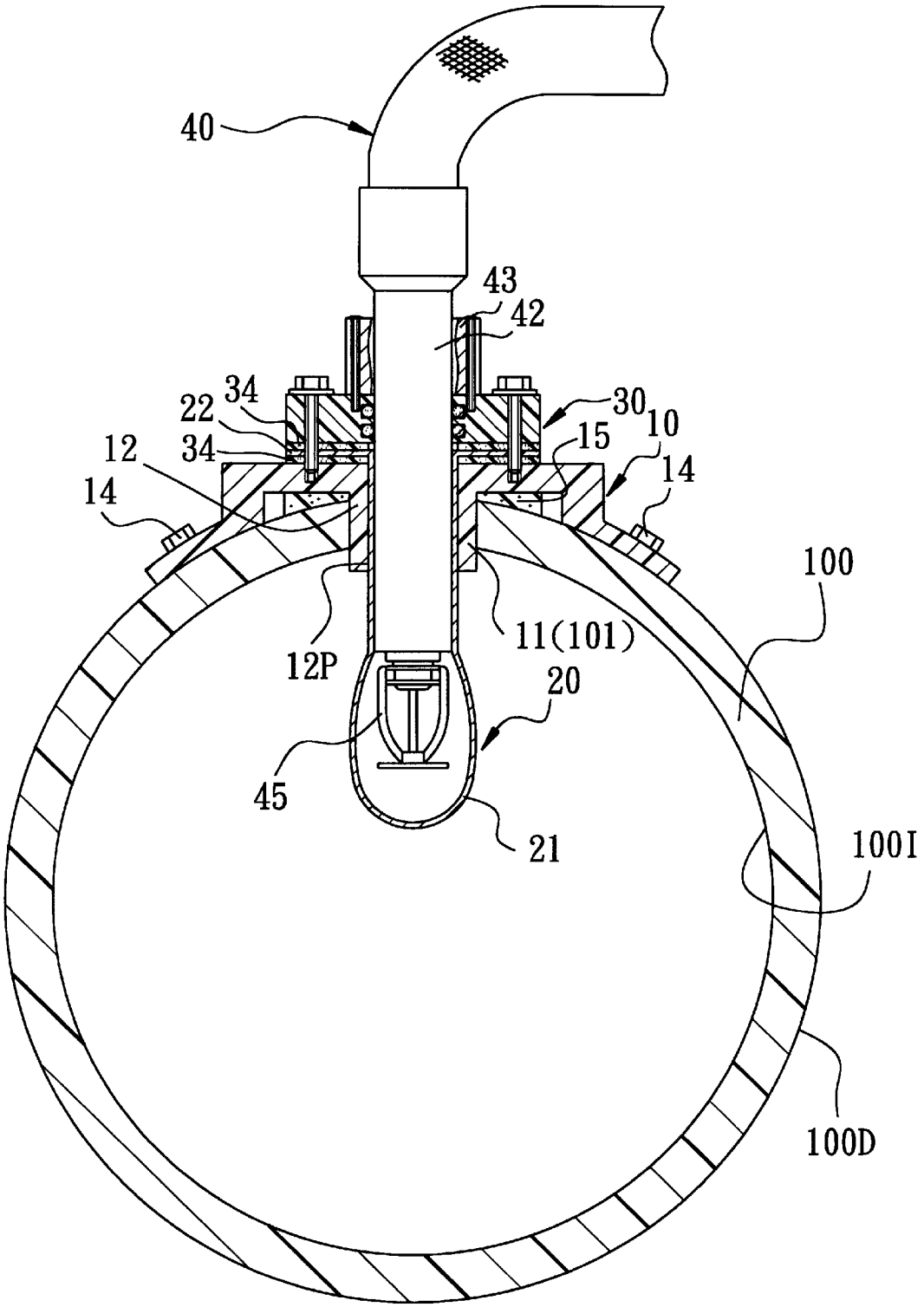
FIG. 3 is a partly sectional view of the preferred embodiment when mounted on the ventilating duct.

Referring to FIGS. 1, 2 and 3, the preferred embodiment of a heat-responsive fire extinguishing assembly of this invention is to be mounted on a ventilating duct 100, as best shown in FIG. 3. The ventilating duct 100 has an inner wall 100I, an outer wall 100D opposite to the inner wall 100I in a radial direction, and an insert hole 101 that extends in a radial direction from the outer wall 100D to the inner wall 100I. The fire extinguishing assembly includes amounting seat 10, an elongate fire extinguishing body 40, a protective cap member 20, a clamping ring 34, and a tightening member 14.

As illustrated, the mounting seat 10 has an inner seat wall 10I adapted to be mounted on the outer wall 100D of the ventilating duct 100 so as to cover the insert hole 101, and an outer seat wall 10D. The outer seat wall 10D has an inner peripheral seat 12 to define a first through hole 11 therein that extends to the inner seat wall 10I. The mounting seat 10 further has an annular insert portion 12P that extends from the inner seat wall 10I and that is in fluid communication with the first through hole 11. The annular insert portion 12P is of such a dimension so as to be adapted to be inserted fittingly into the insert hole 101 to establish a fluid communication between an interior of the ventilating duct 100 and the first through hole 11.

The fire extinguishing body 40 includes a connecting end portion 41 adapted to be connected in fluid communication with a fire extinguishing solution reservoir (not shown), and a free end portion 43 disposed to be in fluid communication with the connecting end portion 41 and to be brought to pass through the annular insert portion 12P so as to be adapted to extend inwardly of the inner wall 100I via the insert hole 101. A valve member (not visible) is disposed between the free end portion 43 and the connecting end portion 41 to control the fluid communication therebetween during on and off states. A nozzle head 45 is mounted on the free end portion 43 for discharging the fire extinguishing solution when the valve member is in the on state. A heat detecting sensor (not visible) is disposed in the free end portion 43 and is adapted to actuate the valve member to the on state when the heat detected thereby reaches a predetermined heat value.

The protective cap member 20 is made of a heat fusible and gas impermeable material and has a closed end portion 21, and an annular end portion 23 that extends in a longitudinal direction from the periphery confining the closed end portion 21 to form an annular edge 22E distal to the closed end portion 21. The cap member 20 is disposed to isolate hermetically the free end portion 43 from an interior of the ventilating duct 100. The cap member 20 further has a mounting flange 22 that is integrally formed with and that extends outwardly and transversely from the annular edge 22E. The mounting flange 22 is of a dimension to abut against the inner peripheral seat 12 when the cap member 20 is brought to isolate hermetically the free end portion 43 and is led through the first through hole 11 from the outer seat wall 10D so as to be adapted to protrude inwardly of the inner wall 100I.

The clamping ring 34 is sleeved movably on the fire extinguishing body 40 so as to be brought to abut against the mounting flange 22 of the cap member 20.

The tightening member 14, preferably in the form of locking screws, is disposed to force the clamping ring 34 to abut against the mounting flange 22 of the cap member 20, thereby tightly sandwiching the mounting flange 22 between the clamping ring 34 and the peripheral seat 12.

In the preferred embodiment, two clamping rings 34 are used to abut opposite sides of the mounting flange 22. A tubular positioning member 30 is disposed threadedly around the connecting end portion 41 of the fire extinguishing body 40 and is fastened to the clamping rings 34 to prevent axial and transverse movements of the fire extinguishing body 40 relative to the mounting seat 10. A tubular fluid seal member 15 is sleeved around the annular insert portion 12P so as to be adapted to be sandwiched between the outer wall 100D of the ventilating duct 100 and the inner seat wall 10I of the mounting seat 10 to provide an effective tight-seal therebetween.

Figure 4:
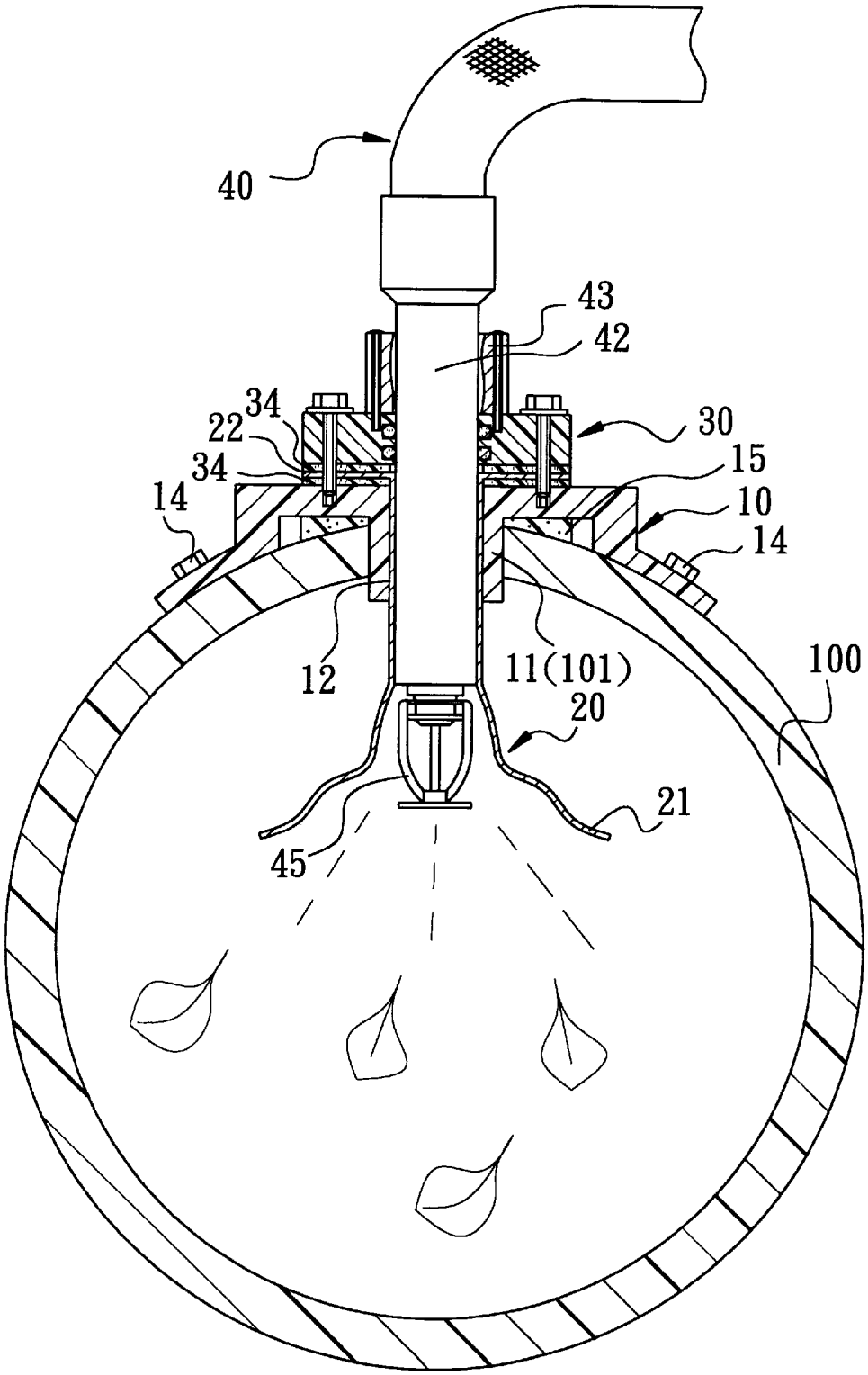
FIG. 4 illustrates how the preferred embodiment operates in the event of a fire in the ventilating duct.

The heat fusible and gas impermeable material for manufacture of the cap member 20 includes a predetermined type of plastic that melts at the predetermined heat value. Alternately, the closed end portion 21 of the cap member 20 can be constructed so as to be capable of rupturing under a predetermined compressed pressure, as best shown in FIG. 4.

Presently, the wires, which are used to connect electrically an electric power source to electric fixtures, are generally embedded in the walls of a building. In the same manner, the ventilating duct 100 equipped with the fire extinguishing assembly of this invention can be used to accommodate the wires therein and can be embedded in the walls to provide additional fire preventing protection to the building. With this invention thus explained, it is apparent that numerous modifications and variations can be made without departing from the scope and spirit of this invention. It is therefore intended that this invention be limited only as indicated in the appended claims.

I claim:

1. A heat-responsive fire extinguishing assembly for a ventilating duct which draws hazardous gas out of a work site, the ventilating duct having an inner wall, an outer wall opposite to the inner wall in a radial direction, and an insert hole extending radially from the outer wall to the inner wall, said fire extinguishing assembly comprising:

a mounting seat including an inner seat wall adapted to be mounted on the outer wall so as to cover the insert hole, an outer seat wall having an inner peripheral seat to define a first through hole therein that extends to said inner seat wall, and an annular insert portion extending from said inner seat wall and in fluid communication with said first through hole, said annular insert portion being of such a dimension so as to be adapted to be inserted fittingly into the insert hole to establish fluid communication between an interior of the ventilating duct and said first through hole;

an elongate fire extinguishing body including a connecting end portion adapted to be in fluid communication with a fire extinguishing solution reservoir, a free end portion disposed to be in fluid communication with said connecting end portion and to be brought to pass through said annular insert portion and so as to be adapted to extend inwardly of the inner wall via the insert hole, a valve member disposed between said free end portion and said connecting end portion to control the fluid communication therebetween during on and off states, a nozzle head disposed in said free end portion for discharging the fire extinguishing solution when said valve member is in the on state, and a heat detecting sensor disposed in said free end portion and adapted to actuate said valve member to the on state when the heat detected thereby reaches a predetermined heat value;

a protective cap member made of a heat fusible and gas impermeable material, and having a closed end portion with a periphery, and an annular end portion extending from said periphery in a longitudinal direction so as to form an annular edge distal to said closed end portion, said protective cap member being disposed to isolate hermetically said free end portion from the interior of the ventilating duct and further having a mounting flange integrally formed with and extending outwardly and transversely from said annular edge, said mounting flange being of a dimension to abut against said inner peripheral seat when said protective cap member is brought to cover said free end portion and is led to pass through said first through hole from said outer seat wall so as to be adapted to protrude inwardly of the inner wall;

a clamping ring disposed to be sleeved movably on said fire extinguishing body so as to be brought to abut against said mounting flange; and a tightening member disposed to force said clamping ring to abut against said mounting flange, thereby tightly sandwiching said mounting flange between said clamping ring and said inner peripheral seat.

2. The heat-responsive fire extinguishing assembly as defined in claim 1, further comprising a positioning member disposed threadedly around said connecting end portion of said fire extinguishing body and fastened to said clamping ring to prevent axial and transverse movements of said fire extinguishing body relative to said mounting seat.

3. The heat-responsive fire extinguishing assembly as defined in claim 1, further comprising a fluid seal member sleeved around said annular insert portion so as to be adapted to be sandwiched between the outer wall of the ventilating duct and said inner seat wall of said mounting seat to provide an effective tight-seal therebetween.

4. The heat-responsive fire extinguishing assembly as defined in claim 1, wherein said heat fusible and gas impermeable material includes a plastic that melts at said predetermined heat value.

5. The heat-responsive fire extinguishing assembly as defined in claim 1, wherein said closed end portion of said protective cap member is capable of rupturing under a predetermined compressed pressure.

* * * * *